United States Patent [19]

Freedom

[11] Patent Number: 4,625,099

[45] Date of Patent: Nov. 25, 1986

[54] FERTILITY CALCULATOR

[76] Inventor: John Freedom, 17100 South Harlem Ave., Tinley Park, Ill. 60477

[21] Appl. No.: 736,108

[22] Filed: May 20, 1985

[51] Int. Cl.[4] ..... G06C 3/00

[52] U.S. Cl. ..... 235/88 RC; 235/78 RC

[58] Field of Search ..... 235/78 R–78 RC, 235/88 R–88 RC

[56] References Cited

U.S. PATENT DOCUMENTS

| | | | |
|---|---|---|---|
| 3,278,118 | 10/1966 | Klein, Jr. | 235/88 RC |
| 3,279,696 | 10/1966 | Sherman | 235/88 RC |
| 3,289,324 | 12/1966 | Benson | 235/78 M |
| 3,929,279 | 12/1975 | Dibley | 235/88 N |

*Primary Examiner*—Benjamin R. Fuller

*Attorney, Agent, or Firm*—Basil E. Demeur; Robert E. Knechtel

[57] ABSTRACT

There is disclosed a calculator adapted to determine optimum monthly fertility time periods of a female formed by a first scale divided into 365 equal units, each unit assigned a day and each month of a full calendar year, a second scale positioned in operative relation to the first scale, the second scale including a plurality of information segments, each of the information segments being sized to correspond with a different menstrual cycle length calculated by the time period between the first day of successive menstrual cycles and ranging between 23 cycle days and 35 cycle days, each of the information segments being spaced from the next adjacent information segment by a spacer segment, each of the spacer segments being of equal size, and each information segment further provided with an optimum fertility indicator segment sized in accordance with a time period equal to two days prior and two days following ovulation, whereby the manipulation of the second scale by placing the indicator indicating the first day of a menstrual cycle of a given cycle length in registry with a particular day and month as noted on the first scale, the optimum fertility indicator formed on the second scale will be automatically positioned with respect to certain days of certain months on the first scale thereby to alert the user as to the optimum fertility time period for conception.

5 Claims, 2 Drawing Figures

FERTILITY CALCULATOR

BACKGROUND OF THE INVENTION

The present invention concerns itself with providing a novel calculator intended to provide fertility information to the female user thereof. One of the difficulties which has prevailed in the field of gynecology has been the inability to accurately predict the time periods, on a monthly basis, when a female is most likely to conceive. It is well known that this information is of critical importance to females having difficulties in understanding and predicting the optimum time periods when conception is most likely to occur, and therefore, experts in the field have employed a host of methods and modes of treatment, including treating female patients with a variety of hormones in order to optimize fertility time periods.

Prior art calculators which have been created exist primarily for the purpose of predicting when a birth will occur if the approximate time of conception is known. Such calculators generally are designed by having a base scale which is divided into the calendar months of a year based upon a 366 day year, and a second scale rotatably movable with respect to the first scale which defines the last menses begun by the female, and then extrapolating a possible date of conception, and then determining the probable implantation and from that date measuring the trimesters until the calculated date of conception can be read from the base scale. Such calculators are fairly common, and again, are merely intended to give a female an expected birth date of a child, primarily based upon the last determinable day when a previous menses occurred. However, heretofore, no calculator hs been provided which will provide information to the female user thereof to indicate an optimum fertility time period, or in the alternative, to indicate an optimum infertility time period.

It is deemed to be quite relevant and important in the field of gynecology and obstetrics to provide a mechanism whereby a female will have the opportunity to determine the most likely time periods on a monthly basis when conception is possible which can be utilized, at least in a first attempt to achieve conception without the need of any mode of treatment with hormones or other such modes of treatment. It is deemed desirable to provide a simple calculator which is designed to calculate optimum fertility time periods regardless of the actual menstrual cycle of a female, so long as such cycles fall within the overall general average of menstrual cycles. Hence, the calculator of the present invention will function, if properly utilized, to indicate the optimum periods of fertility, as well as the optimum periods of infertility.

OBJECTS AND ADVANTAGES

It is therefore the object of the present invention to provide a calculator adapted to determine optimum monthly fertility time periods of a female regardless of variations in menstrual cycle lengths, so long as such cycle lengths fall within the overall averages of between 23 and 35 days, and further calculated on the basis of ovulation occurring approximately fourteen days prior to the commencement of the next menstrual cycle, such that the simple manipulation of a two scale calculator will yield information as to the optimum fertility time period for each month.

In conjunction with the foregoing object, it is a further object of the present invention to provide a calculator of the type described, which includes a first scale divided into 365 units representing a day in each month of a full calendar year, and a second scale postioned in operative relation with respect to the first scale, the second scale including a plurality of information segments each of which is sized to correspond with a different menstrual cycle length calculated by the time period between the first day of successive menstrual cycle and ranging between 23 cycle days and 35 cycle days, each of the information segments being spaced from the next adjacent information segment by a spacer segment, each of the spacer segments being of equal size, and each information segment further provided with an optimum fertility indicator segment included therein and sized in accordance with a time period equal to two days before and two days following ovulation, whereby manipulation of the second scale including the information segments and spacer segments relative to the first scale which incorporates 365 equal units representing a day of each calendar year will position the optimum fertility indicator segment in a specific position such that the optimum fertility time period by day and month may be read off of the first scale.

In conjunction with the foregoing object, it is a further object of the invention to provide a calculator of the type described above, wherein a total of thirteen information segments are provided on the second scale, each of the thirteen information segments representing a menstrual cycle length of between 23 and 35 days, and each segment is further sized by the length of time in each different menstrual cycle occurring between the first day of menses and the first day of ovulation, the optimum fertility indicator segment being constructed by measuring two days prior to and two days subsequent to the day of ovulation such that the optimum fertility indicator segment may be positioned in registry with a specific time period relative to the information set forth on the first scale.

SUMMARY OF THE INVENTION

In summary, the present invention is intended to provide a novel calculator which is adapted to permit information as to optimum fertility time periods on a monthly basis to be quickly and efficiently determined by the user thereof. The calculator of the present invention is designed as a two scale calculator, having a base scale as the first scale including 365 units arranged in a circular configuration, and representing a day of each calendar year, and the second scale including a plurality of thirteen informational segments, each of the informational segments corresponding with menstrual cycle lengths of between 23 and 35 days. Each of the information segments is designed in a triangular configuration having an arcuate base, the length of the arcuate base being calculated by determining the time period existing between the first day of a given menses, and the day of ovulation relative to such a menstrual cycle, and each informational segment further incorporating an optimum fertility indicator segment constructed by measuring a time period two days prior to and two days subsequent to the day of ovulation such that the calculator may be employed by manipulating the second scale and placing the first day of menses of any given menstrual cycle in registry with a particular day of a particular month as set forth on the first scale, and then reading the time period indicated by the optimum fertility indicator segment as the same comes into registry with a particular time frame set forth on the first scale.

It is contemplated that the calculator of the present invention will be useful in between 95% and 99% of females given the fact that on an average basis, ovulating menstrual cycles have been found to range between 23 and 35 days. Hence, for females having menstrual cycles within that range, the calculator of the present invention will provide on the average, and in most instances, an indication as to the optimum fertility time periods for achieving conception, and will further indicate the optimum time periods when infertility is most likely.

DETAILED DESCRIPTION OF DRAWINGS

Figure 1:
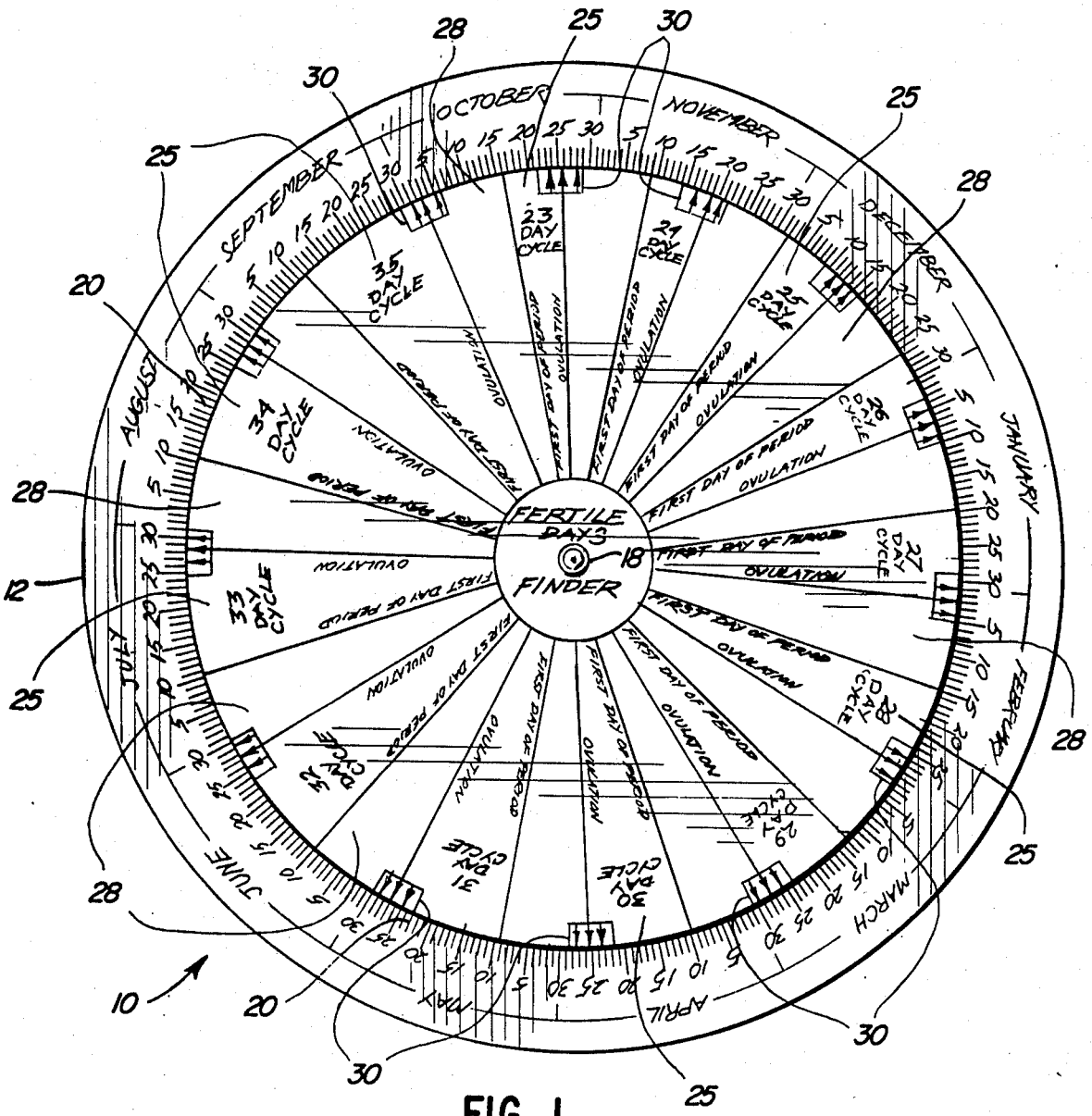
FIG. 1 is a top plan view showing the calculator of the present invention and indicating the base scale having the days of the calendar year set forth thereon in 365 equal units, and the second scale having the information segments in the optimum fertility indicator segments contained thereon and designed to operate in registry with the first scale.
Figure 2:
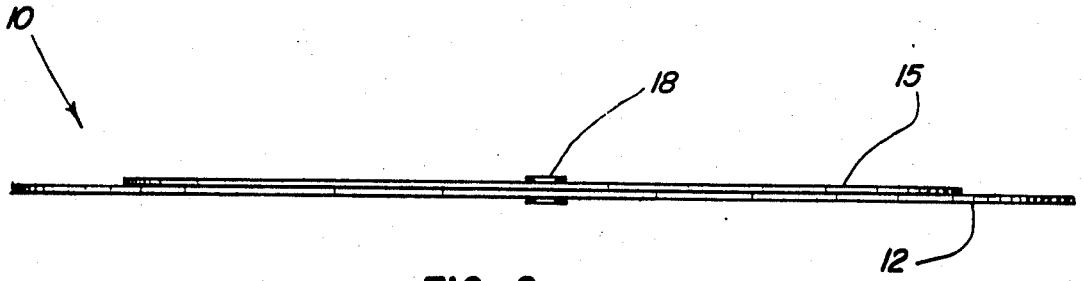
FIG. 2 is a side-elevational view showing the manner in which the first scale and the second scale are rotatably mounted with respect to the other in order to achieve the calculating function of the present invention.

The calculator of the present invention is set forth in FIG. 1 of the drawings. It will be noted by viewing both FIGS. 1 and 2 of the drawings, that the calculator, generally defined by the numeral 10 includes a first base scale 12 and a second scale 15 mounted in operative relationship relative to the first base scale 12. As shown in FIG. 2 of the drawings, the second scale 15 and first scale 12 are mounted in operative relation by means of a pivot pin 18 such that the two scales are rotatably movable one with respect to the other.

As illustrated in FIG. 1, the first base scale 12 is provided with 366 equal units 20, each unit representing a day of a calendar year. As further shown in FIG. 1, the first base scale 12 is further constructed indicating each of the months of the year, with each of the days of each month clearly designated by a unit 20. The information contained in the first base scale 12 may be conveniently applied to the first scale by printing the same, or utilizing any type of an overlay process to imprint the information thereon.

The second scale 15 is shown to include a series of thirteen information segments 25. Each of the thirteen information segments is constructed to correspond with the average number of days determined as the average menstrual cycles in a female. In this connection, it is known that in most women, an average menstrual cycle may range from between 23 days and 35 days. Menstrual cycles less than 23 days or in excess of 35 days, by empirical knowledge, do exist, but are in the clear minority of women and are non-ovulatory. Hence, the present calculator is designed for use by women who have menstrual cycles ranging between 23 and 35 cycle days.

It will be noted that each information segment 25 is constructed in a triangular configuration, having an arcuate base, with each information segment 25 being of a slightly different size than each next adjacent segment. Furthermore, each information segment 25 is spaced from the next information segment 25 by a spacer segment 28, each of the spacer segments 28 being of equal size.

Finally, the calculator construction is completed by each information segment 25 including an optimum fertility indicator segment 30 which is constructed as will be more fully set forth hereinafter.

In order to construct the calculator 10 of the present invention, certain information is either known or assumed. For example, a female menstrual cycle is presumed to be defined as the time period which passes between the first day of a given menstrual cycle to the first day of the next menstrual cycle of a given female. As indicated previously, such cycles will range between 23 days and 35 days. Furthermore, it is known that on the average basis, menses will commence approximately fourteen days after ovulation has occurred if fertilization has not occurred. It can therefore be computed that, for example, if a female has a 23 day menstrual cycle, ovulation will generally occur nine days after the start of her menstrual cycle, and menses will commence fourteen days thereafter. Hence, this represents a 23 day cycle. Given this information, in constructing a calculator 10 of the present invention, each information segment is constructed in accordance with the total number of days needed to accommodate the thirteen most average menstrual cycles, ranging between 23 days and 35 days. Since menstrual cycles, in the absence of pregnancy, commence 14 days after ovulation, one can estimate the occurrence of ovulation from the 1st day of menstruation in any cycle length by deducting 14 from the length of that cycle, i.e. if a woman's menstrual cycle is 23 days, then ovulation occurs on the 9th day (23−14=9) following the onset of menstruation. This calculation is carried out for the cycles 23 to 35 as follows:

| | |
|---|---|
| 23 − 14 = | 9 |
| 24 − 14 = | 10 |
| 25 − 14 = | 11 |
| 26 − 14 = | 12 |
| 27 − 14 = | 13 |
| 28 − 14 = | 14 |
| 29 − 14 = | 15 |
| 30 − 14 = | 16 |
| 31 − 14 = | 17 |
| 32 − 14 = | 18 |
| 33 − 14 = | 19 |
| 34 − 14 = | 20 |
| 35 − 14 = | 21 |
| | 195 |

Thus 195 days are utilized for the segments 25.

In subtracting 195 days from a total of 365 days, a total of 170 days are left which, if divided by 13, that being the number of information segments 25, a total of thirteen days, on the average, remains to construct thirteen spacer segments 28. As indicated previously, each spacer segment 28 is calculated to be of equal size, and if each of such spacer segments is approximately thirteen days in length, the sizing of the calculator may be completed.

As illustrated in FIG. 1, and taking for example, a menstrual cycle of 23 days, it will be observed that the triangular configuration of the information segment 25 representing a 23 day menstrual cycle will have an arcuate base measuring approximately nine days as read on the first scale. Similarly, the information segment 25 representing a 24 day menstrual cycle will have an arcuate length corresponding to ten days as measured on the first scale. Each information segment 25 of progressively larger menstrual cycles will similarly be somewhat greater in arcuate length calculated in the manner indicated above. It will further be noted that each information segment 25 is spaced from the next information segment 25 by an equally sized spacer segment 28.

It will further be noted that each information segment 25, being triangular in configuration, is constructed by determining the first day of a menstrual cycle, representing one leg of the triangle, and the day of ovulation representing the opposed leg of the triangle. It is further known that a female is most fertile approximately two days prior to and two days subsequent to the time of ovulation. Hence, each of the fertility indicator segments is constructed by measuring off a time period of two days prior to and two days subsequent to the day of ovulation.

Given the above information, it will now be appreciated the manner in which the calculator 10 may be utilized by a female. If a female has determined, based upon empirical knowledge, that she has a given menstrual cycle, for example, a 29 day cycle, she may now manipulate the calculator by placing the first day of her menses given a 29 day menstrual cycle, on the day upon which it occurs as determined on the first scale 12. As shown in FIG. 1 of the drawings, if the first day of menses occurred on Mar. 13th, the calculator indicates that the day of ovulation should occur on or about March 28th, and therefore, the period of greatest fertility will be a time period measured by approximately two days before and two days after the day of ovulation. Hence, the fertility indicator segment 30 associated with the 29 day menstrual cycle indicates that the period of optimum fertility shown by ↑ ↑ ↑ symbol on calculator 10 will exist between March 26th and March 30th. The calculator 10 will further indicate that the periods of greatest infertility are somewhat longer and exist between March 24th and March 31st and shown by ⊔ symbol on calculator 10. Hence, the calculator 10 of the present invention is adapted to indicate both the periods of optimum fertility, as well as the periods of optimum infertility.

In order to give a further example as illustrated in FIG. 1 of the drawings, if one takes, for example, a 31 day menstrual cycle as illustrated in FIG. 1, and if it is determined that the first day of menses commenced on May 9th, the female would manipulate the second scale until the first day of her menses as illustrated for a 31 day menstrual cycle is placed into registry with May 9 as illustrated on the first scale 12 of the calculator 10. This will automatically position the fertility indicator segment to the days between May 25, and May 29. Hence, any female would then know that the time period of optimum fertility would exist sometime between May 25th and May 29th as representing the time period of the greatest possibility of conception. A female would similarly realize that the time period prior to May 23rd, or subsequent to May 30th, would represent time periods of lesser fertility and greater infertility.

It will be appreciated that the calculator 10 of the present invention therefore provides an efficient and easy to use device for indicating to a female user the most optimum time periods for conception. It is therefore believed that by first utilizing a calculator constructed in accordance with the present invention, attempts to achieve conception may be enhanced and perhaps permit the female to avoid any subsequent mode of hormonal treatment or other types of treatment as an inducement to achieving conception. Obviously, if after many attempts of attempting conception do not take results, despite the use of the calculator 10 of the present invention, it is possible that other physical or hormonal problems may exist, and therefore, a mode of treatment may be indicated. It is contemplated, however, that by first utilizing the calculator of the present invention, a female may be able to at least attempt conception without the need of any treatment, and at least the possiblity that conception was attempted at inappropriate times may be eliminated from consideration in determining a course of treatment.

While the present invention is indicated to be a calculator designed in circular configuration, it will be appreciated that various modifications may be made therein without changing the essence of the invention. For example, it is possible that the calculator of the present invention may be constructed in lineal fashion, in the nature of a slide rule, but it is contemplated that if the calculator is constructed in accordance with the calculations as described herein, the calculator should operate in the same manner to efficiently yield up the same information. Hence, the particular configuration of the calculator is not deemed to be critical to the present invention.

While there has therefore been described what is considered to be the preferred embodiment of the invention, clearly, various modifications may be made therein without departing from the true spirit and scope of the invention, and it is intended to cover in the appended claims all such modifications as fall within the true spirit and scope of the present invention.

I claim:

1. A fertility calculator adapted to determine optimum monthly fertility time periods regardless of variations in menstrual cycle lengths, and calculated on the basis of ovulation occurring approximately fourteen days prior to the commencement of the next menstrual cycle, comprising in combination, a first scale disc having the circumference thereof divided into 365 equal units, each unit representing a day in each month of a full calendar year, a second scale disc being affixed to and positioned in rotatable operative relation to said first scale disc, said second scale disc including:

(a) a plurality of information segments formed thereon and being successively sized to correspond with a different menstrual cycle length calculated by the time period between the first day of successive menstrual cycles and ranging between 23 cycle days and 35 cycle days, (b) each of said information segments being spaced from the next adjacent information segment by a spacer segment, (c) each of said spacer segments being of equal size, and each information segment further provided with an optimum fertility indicator segment formed thereon and sized in accordance with a time period equal to two days before and two days following ovulation, whereby a particular optimum fertility time period may be determined by aligning the first determined day of a designated menstrual cycle length of the appropriate information segment of said second scale disc with the month and day of the occurrence of menstrual cycle on said first scale disc by rotating said second scale disc with respect to said first scale disc, thereby to align the optimum fertility indicator segment with a designated portion of said first scale disc to effectively determine the designated days of a particular month for the optimum fertility time period.

2. The optimum fertility calculator as set forth in claim 1, wherein said first scale disc is constructed in a circular configuration having a fixed diameter and having said 365 equal units designating calendar days circumferentially disposed thereabout, and said second scale disc is similarly constructed in a circular configuration having a fixed diameter smaller than said first scale disc and having said information segments, spacer segments, and fertility indicator segments formed thereon, said first and second scale discs being rotatably mounted to one another such that designated information on said second scale disc may be positioned in registry with designated information on said first scale disc thereby to permit information contained in said information segments to be aligned with the appropriate calendar days designated on said first scale disc to provide optimum fertility time period information to the user thereof.

3. The optimum fertility calculator as set forth in claim 2 above, wherein a total of thirteen information segments are provided on said second scale disc, each of said information segments being successively sized from smaller to larger and representing a menstrual cycle ranging between 23 days and 35 days.

4. The optimum fertility calculator as set forth in claim 3 above, wherein each information segment is constructed in a triangular configuration, and having an arcuate base, the size of which is determined by the number of days for each given cycle before ovulation occurs as measured from the first day of the previous menstrual cycle, each information segment being progressively larger.

5. The optimum fertility calculator as set forth in claim 4 above, wherein each spacer segment is constructed in a triangular configuration and having an arcuate base which corresponds to a total of 13 days as measured on said first scale disc.

* * * * *